US008004169B2

(12) United States Patent
Li et al.

(10) Patent No.: US 8,004,169 B2
(45) Date of Patent: Aug. 23, 2011

(54) LED LAMP ASSEMBLY

(75) Inventors: Xiao-Li Li, Kunshan (CN); Ping-Sheng Su, Tu-Cheng (TW)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 410 days.

(21) Appl. No.: 12/217,214

(22) Filed: Jul. 1, 2008

(65) Prior Publication Data

US 2009/0015127 A1 Jan. 15, 2009

(30) Foreign Application Priority Data

Jul. 10, 2007 (CN) ..... 2007 2 0040635.X
Aug. 28, 2007 (CN) ..... 2007 2 0045594.3

(51) Int. Cl.
*H01J 5/48* (2006.01)

(52) U.S. Cl. ..... 313/318.05; 313/318.01; 313/315

(58) Field of Classification Search ..... 313/315, 313/318.01, 318.05; 362/652–655, 249.14, 362/249.16, 249.19; 439/188
See application file for complete search history.

(56) References Cited

U.S. PATENT DOCUMENTS 5,121,310 A * 6/1992 Ahroni ..... 362/238
5,718,502 A 2/1998 Tseng
5,829,865 A * 11/1998 Ahroni ..... 362/657

* cited by examiner

*Primary Examiner* — Peter J Macchiarolo
*Assistant Examiner* — Donald L Raleigh
(74) *Attorney, Agent, or Firm* — Wei Te Chung; Andrew C. Cheng; Ming Chieh Chang

(57) ABSTRACT

A LED lamp assembly (100) includes a LED light (1); a lamp holder (2) having a body portion (21) enclosing a hollow portion (23) to partially retain the LED light therein; a lamp base (3) including a cylindrical peripheral wall (31) and rear wall (32) connecting to the peripheral wall to define a socket (30) with a front opening, said lamp base (3) further having two cable retainers (34) seated in the socket (30) and discrete from the peripheral wall (31); a pair of cables (4) respectively extending into the cable retainers via at least a cable passage (321) of the rear wall. The lamp holder is press-fit into space between the cable retainer and the peripheral wall of the lamp base to urge the cable retainers clamping the cables.

10 Claims, 6 Drawing Sheets

LED LAMP ASSEMBLY

FIELD OF THE INVENTION

This application claims priority to prior Chinese patent applications 200720040635.X and 200720045594.3, the disclosure of which is incorporated herein by reference.

The present invention generally relates to a lamp assembly, and more particularly to a LED (light emitting diode) lamp assembly which has the LED lamp and wires directly achieve electrical connection without any other intermediate means.

DESCRIPTION OF PRIOR ART

In Christmas or other celebrated Festivals, lamp assemblies are widely used for decoration so as to create amicable atmosphere. The previous (and existing) lamp assembly mainly uses incandescent lamp, which consumes great power energy. LED lamp is newly emerged high effective illuminate device, having some advantages, such as lower profile, little energy consumption and long life span, etc.

CN Pat. No. 2392977 issued on Aug. 23, 2000 to Tseng discloses a decorative lamp for festive occasions. The decorative lamp includes a lamp bulb, a lamp holder, a lamp base, two wires and two slim metal sheets. The lamp bulb is retained with the lamp holder, with pair of electrodes thereof extending through an peripheral portion of the lamp holder and accessible from outside. The lamp base defines a hollow portion therein, and the slim metal sheets are coupled to the two wires and securely attached to an inside wall of the lamp base. The lamp bulb together with the lamp holder are assembled to the lamp base, with the pair of electrodes contacting the pair of conductive pads, respectively. However, as the aforementioned lamp is relative complicated and laborious, which may not be manufactured easily and further increase cost.

Hence, an improved lamp assembly is highly desired to overcome the aforementioned problems.

SUMMARY OF THE INVENTION

Accordingly, an object of the present invention is to provide a lamp assembly which may be manufactured easily and lower cost.

In order to achieve the object set forth, a lamp assembly in accordance with the present invention comprises a base defining a socket, with a pair of cable retainers arranged in the socket; a pair of cables respectively extending into the pair of cable retainers and secured in the cable retainers, each cable having at least a conductor enveloped with jacket; a lamp bulb having a body partially received in the socket of the base, with a pair of legs thereof respectively penetrating into corresponding cables to contact the conductors.

Other objects, advantages and novel features of the invention will become more apparent from the following detailed description when taken in conjunction with the accompanying drawings.

DETAILED DESCRIPTION OF PREFERRED EMBODIMENTS

Figure 1:
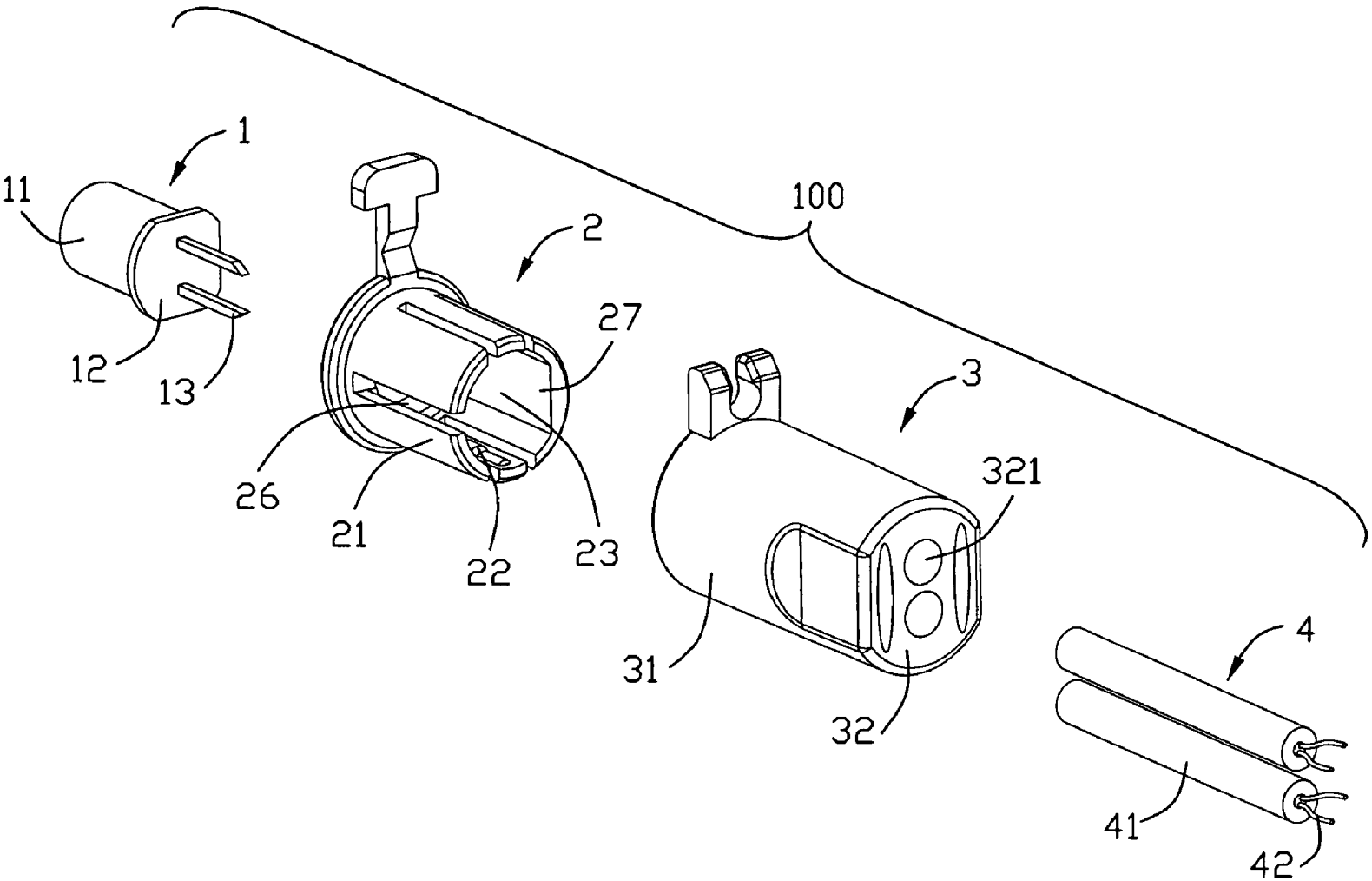
FIG. 1 is an exploded, perspective view of a lamp assembly of a first embodiment in accordance with the present invention.
Figure 2:
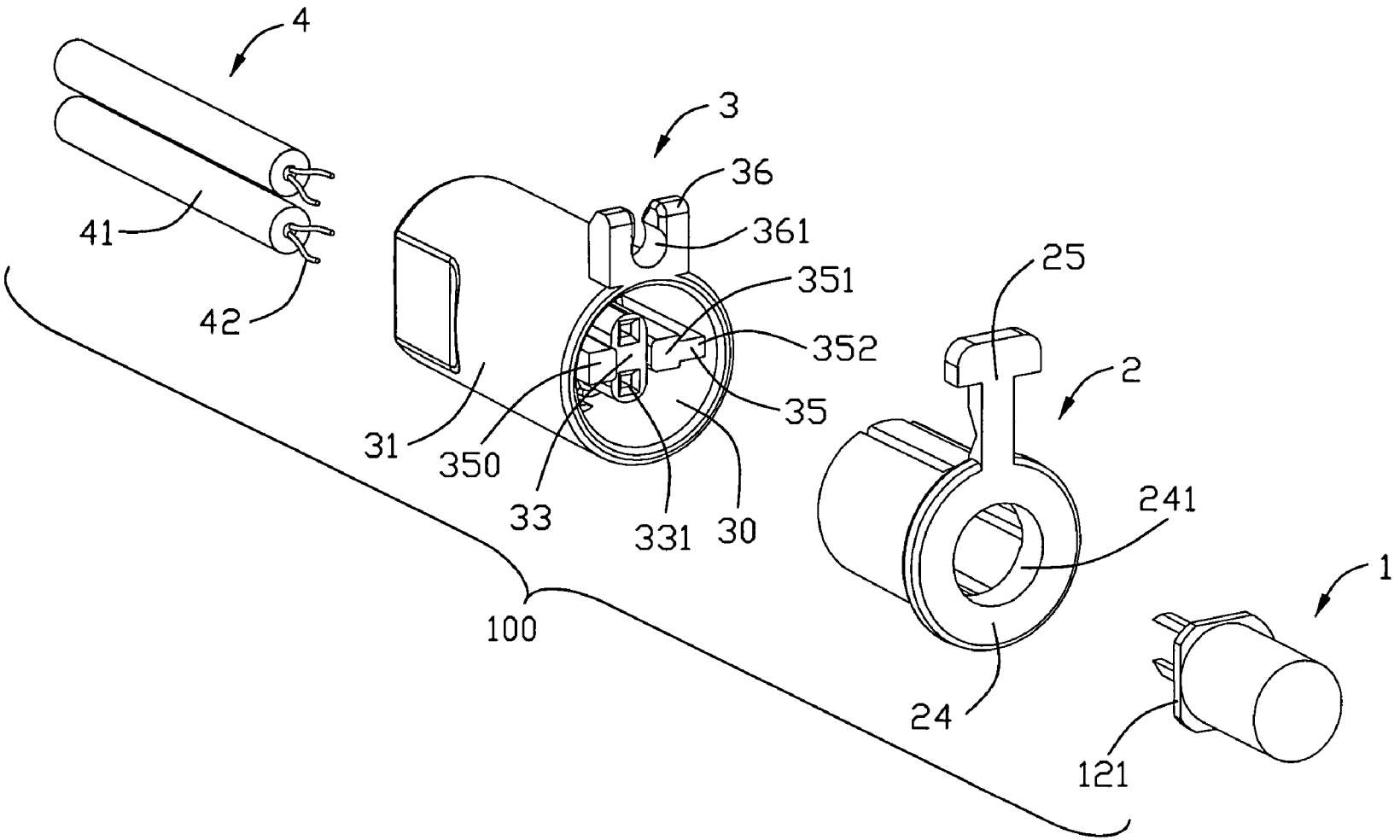
FIG. 2 is similar to FIG. 1, but viewed from another aspect.
Figure 3:
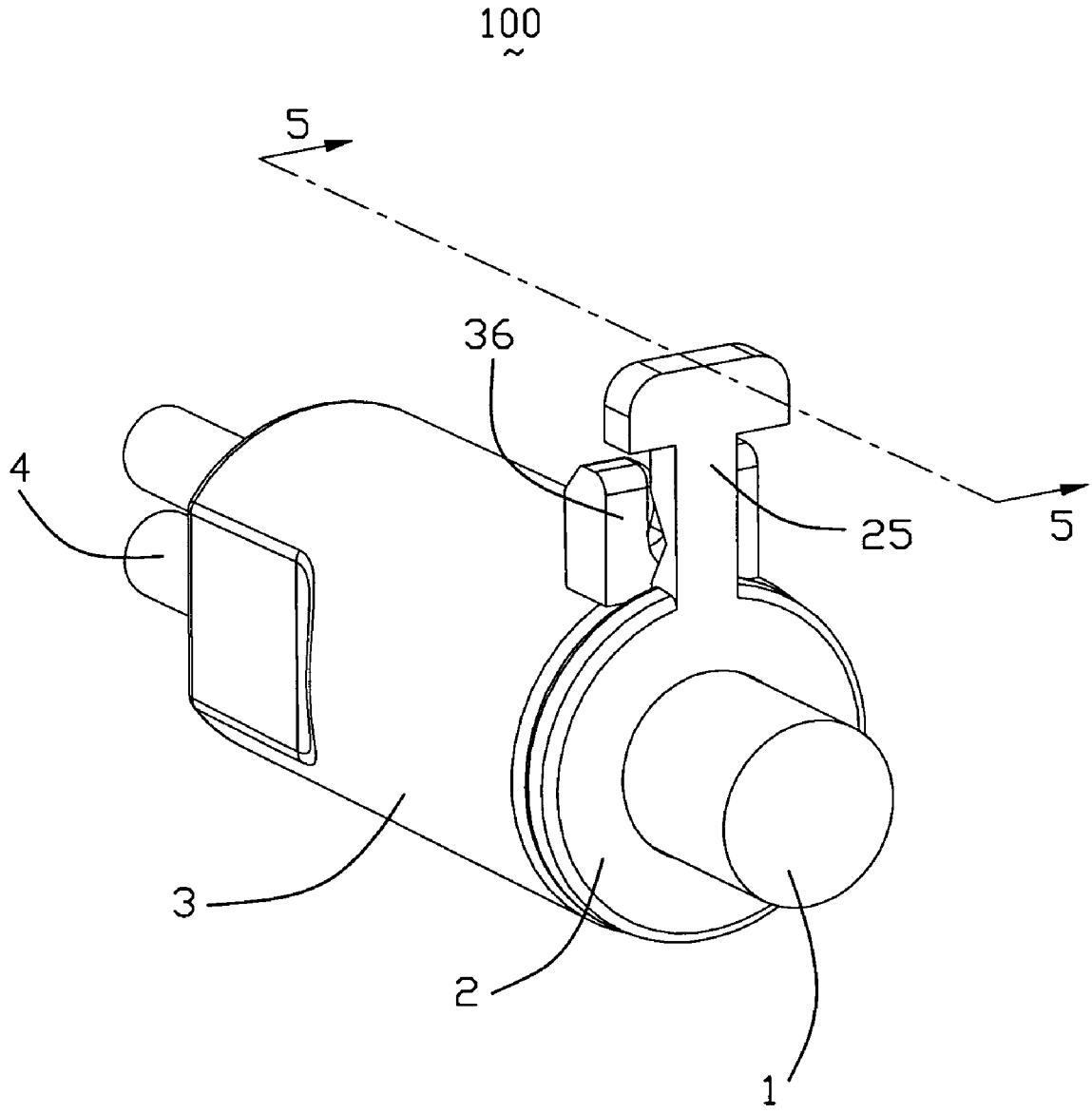
FIG. 3 is an assembled, perspective view of the lamp assembly.
Figure 4:
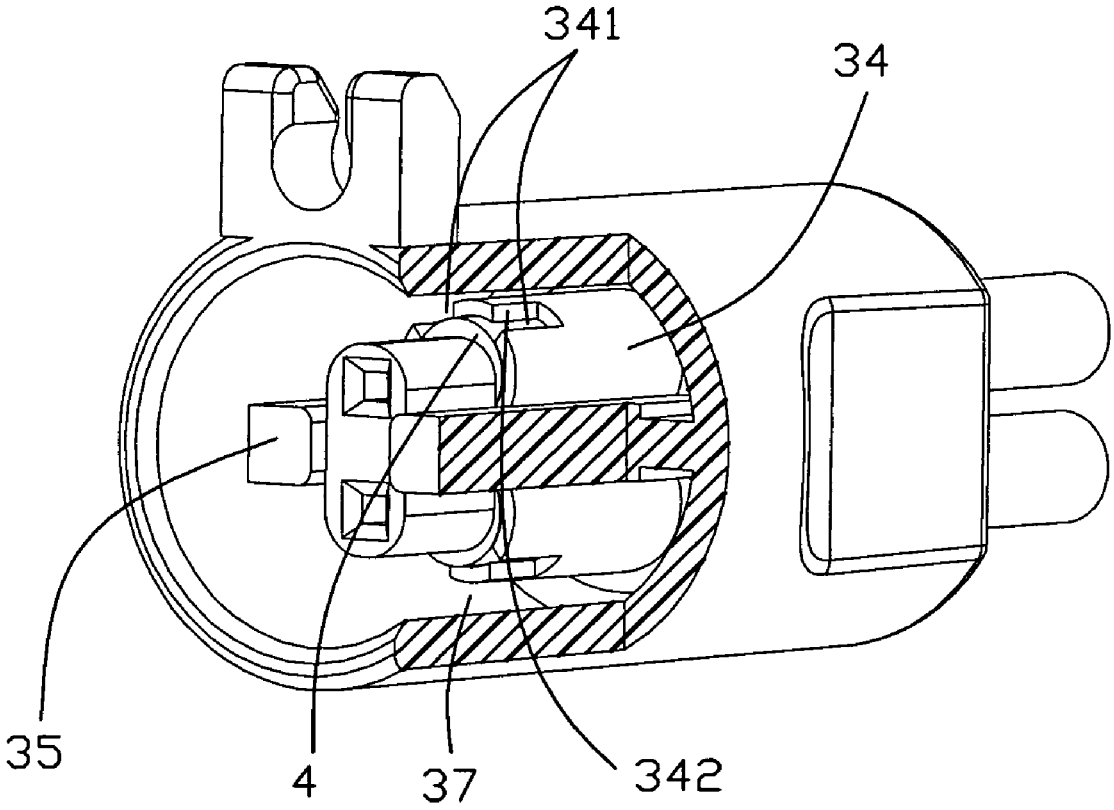
FIG. 4 is a partial cross-section view of the lamp assembly.
Figure 5:
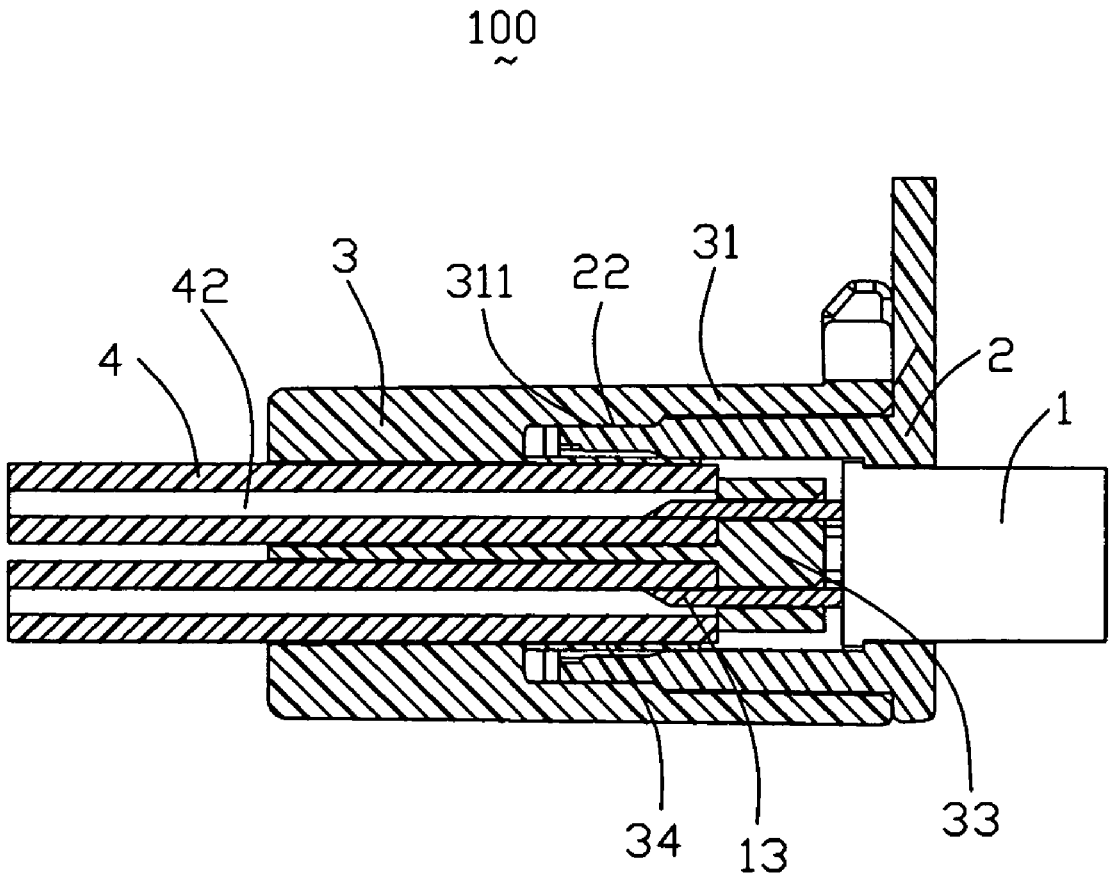
FIG. 5 is a cross-section view of FIG. 3 taken along line 5-5.

Reference will now be made in detail to the preferred embodiment of the present invention.

Referring to FIGS. 1-5, a lamp assembly 100 in accordance with the present invention comprises a lamp bulb 1, a lamp holder 2, a lamp base 3 and two cables 4.

The lamp bulb 1 utilizes LED (Light Emitting Diode) as light source, but other light source, such as incandescence light is available. The lamp bulb 1 includes a lens body 11 with a LED chip (not shown) therein, a substrate 12 for supporting the lens 11, and a pair of legs 13 connecting the lens body 11 and extending outside through the substrate 12. Partial of the substrate 12 is cut to form a planar side.

The lamp holder 2 has body portion 21 enclosing a hollow portion 23 therein and a lid 24 formed at a front end of the body portion 21. The body portion 21 is circular-shaped view along front-to-back direction, however, in alternative embodiments, other different shapes, such as rectangular shape, elliptic shape, etc. are available. A number of lengthwise slots 26 are defined in the body portion 21 and further communicate with the hollow portion 23. An inside surface of the body portion 21 has two step protrusion 22 arranged at opposite sides thereof. Partial curved inside surface of the body portion 21 is configured to a planar surface 27 to match corresponding planar side of the substrate 12, which may ensure the LED lamp 1 properly assembled to the lamp base 3 and further prevent the LED lamp 1 being turned, causing short circuit problem. The lid 24 further defines an outlet 241 in a central portion thereof. The outlet 241 has substantially same cross-section as that of the lens 11, thus, the LED lamp 1 is retained in the hollow portion 23 of the lamp holder 2, with the lens 11 of the LED lamp 1 protruding outside through the outlet 241 of the lid 24. A T-shaped clasp 25 is formed at a lateral side of the lid 24.

The lamp base 3 includes a cylindrical peripheral wall 31 and rear wall 32 connecting to the peripheral wall 31 to define a socket 30 with a front opening (not numbered). The lamp base 3 has two protrusions 311 arranged on inside surface of the peripheral wall 31 thereof and further aligning with the two step protrusions 22 along a radial direction. A pair of cable passages 321 arranged in the rear wall 32. Two pipe-shaped cable retainers 34 are received in the socket 30 and integrated with the rear wall 32 of the lamp base 3 and discrete from the peripheral wall 31. However, it should be aware that a large cable passage accommodating two cables simultaneously is available. The two cable retainers 34 further align with and communicate with the pair of cable passages 321 along an axial direction (longitudinal direction). A number of short slots 341 are defined in a front portion of each of the cable retainers 34 to separate it into a number of front pieces 342. A first post 35 and a second post 350 extend forwardly from the rear wall 32 and are disposed at opposite outsides of the pair of cable retainers 34. The first post 35 has a main portion 351 and a neck portion 352 protruding outwardly from the main portion 351 and further connecting to the peripheral wall 31. The second post 350 has substantially same structure as that of the main portion 351 of the first post 35. The second post 350 is apart from the peripheral wall 31. When the lamp holder 2 is inserted into the socket 30 of the lamp base 3, the neck portion 352 slides along one of the slots 26 of the body portion 21, until they are fully mated, and such configuration may achieve anti mismating effect.

An ellipse-shaped guider member 33 is made of insulative material and arranged between the first post 35 and the second post 350, in front of the cable retainers 34. The guider member 33 further defines two through passageways 331 along a longitudinal direction. The through passageways 331 further align with the pair of cable passages 321, respectively. An attached member 36 is arranged at a lateral portion of a front segment of the peripheral wall 31, and a Ω-shaped cavity 361 is defined in the attached member 36.

Each of the cables 4 has a number of tiny conductors 42 therein and a jacket 41 shielding the conductors 42.

When assembly, the cables 42 are insert into the cable passages 321 of the lamp base 3, with front ends thereof abutting back ends of the insulator. Secondly, the lamp bulb 1 is assembled to the lamp holder 2, then they are together assembled to the lamp base 3, with legs 13 thereof sliding along the passageways 331 of the guider member 33 and penetrating into the cables 4 and contacting conductors 42 therein to form electrically connection therebetween, the body portion 21 of the lamp holder 2 press-fit into space 37 between the cable retainers 34 and cylindrical peripheral wall 31 of the lamp base 3 to urge the front pieces 342 clamping the cables 4, thus the cables 4 are secured in the cable retainers 34. The step protrusion 22 of body portion 21 and the protrusion 311 of the cylindrical peripheral wall 31 may increase combination between the lamp holder 1 and the lamp base 3. Fourthly, the clasp 25 latches with the attached member 36 to make the LED lamp 1, the lamp holder 2, the lamp base 3 and the cables 4 combined together more reliably.

Figure 6:
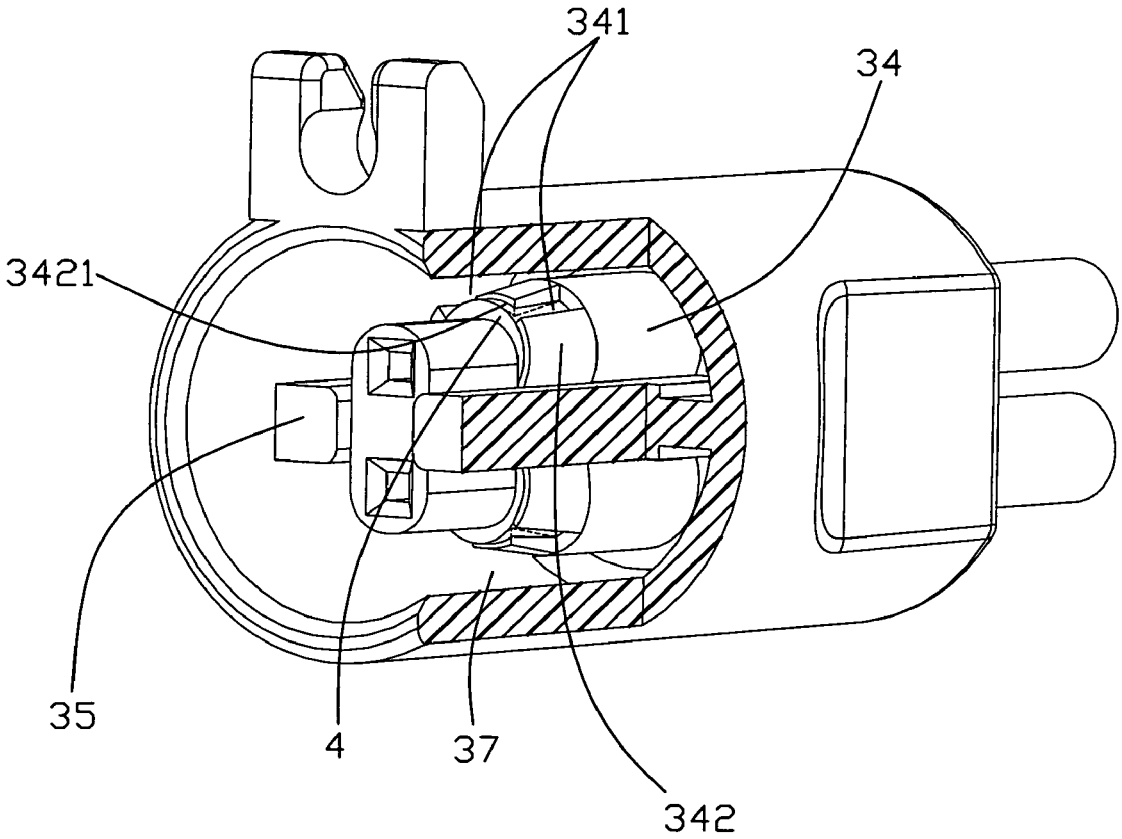
FIG. 6 is a partial cross-section view of the lamp assembly of a second embodiment in accordance with the present invention.

Referring to FIG. 6, another embodiment of the present invention illustrates that the cables 4 retained with the cable retainers 34 by different method. Free ends 3241 of the front pieces 342 of the cable retainers 34 are acute and bias toward inwardly. When the cables 4 extend into the cable retainers 34 and reach an end of the guider members 33, the free ends 3241 automatically press onto and bite the jacket 41, thus the cables 4 are secured in the retainers 34 and unable to slide out of the cable retainers 34. Other structures and the assemble process of the instant embodiment are similar to these of the first embodiment, and detailed depiction is omitted hereby.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A lamp assembly, comprising:

a base defining a socket, with a pair of cable retainers arranged in the socket;

a pair of cables respectively extending into the pair of cable retainers and secured in the cable retainers, each cable having at least a conductor enveloped with jacket;

a lamp bulb having a body partially received in the socket of the base, with a pair of legs thereof respectively penetrating into corresponding cables to contact the conductors;

wherein the lamp base includes a peripheral wall and a rear wall connecting to the peripheral wall to enclose the socket with a front opening, wherein the pair of cable retainers are integrated with the rear wall wherein a lamp holder having a body portion enclosing a hollow portion to partially retain the lamp bulb therein wherein the body portion of the lamp holder defines a number of lengthwise slots;

wherein a post is arranged in the socket of the lamp base, with a neck portion attached to the peripheral portion of the lamp base, wherein the neck portion is received in one of the lengthwise slots.

2. The lamp assembly as recited in claim 1, wherein the rear wall of the lamp base defines two cable passages align and communicate with the pair of cable retainers, respectively.

3. The lamp assembly as recited in claim 1, wherein a front portion of each cable retainer defines a number of slots, each slot extending along an axial direction.

4. The lamp assembly as recited in claim 3, wherein the lamp holder is press-fit into a space between the cable retainer and the peripheral wall of the lamp base to urge the cable retainers clamping the cables.

5. The lamp assembly as recited in claim 4, wherein the lamp holder has two step protrusion arranged on inside surface thereof, wherein the lamp base has two protrusions arranged on inside surface thereof and aligning with the two step protrusions along a radial direction.

6. The lamp assembly as recited in claim 1, wherein the lamp holder further has a lid with an outlet to allow a partial of the lamp bulb through.

7. The lamp assembly as recited in claim 6, wherein a clasp is formed at a lateral portion of the lid of the lamp holder, wherein an attached member with a cavity is arranged at lateral portion to latch with the clasp.

8. A lamp assembly comprising:

a base defining a socket unitarily equipped with a pair of cable retainers;

a pair of cables extending into and secured within the corresponding cable retainers, respectively, and each of said cables including an inner conductor and an outer jacket concentrically;

a lamp bulb assembled to the socket via a lamp holder, said lamp bulb including a pair of legs each axially extending into a center of the corresponding outer jacket so as to be mechanically and electrically engaged coaxially with the corresponding inner conductor.

9. The lamp assembly as claimed in claim 8, wherein a distance between the pair of legs is essentially similar to that between the pair of said cable retainers.

10. The lamp assembly as claimed in claim 9, wherein said socket further unitarily includes a guider member, in front of the cable retainers, defining a pair of passageways dimensioned snugly receiving the corresponding legs and coaxially communicating with the corresponding cables, respectively.

* * * * *